United States Patent [19]

Buschmann et al.

[11] 4,181,847

[45] Jan. 1, 1980

[54] APPARATUS FOR SYNCHRONIZING THE SPEEDS OF TWO WEBS OF GOODS

[75] Inventors: Gerhard Buschmann, Dusseldorf; Karl Thievessen, Hilden; Peter Weiss, Monheim-Baumberg; Werner Reitter, Neuss-Erfttal, all of Fed. Rep. of Germany

[73] Assignee: Jagenberg-Werke Aktiengesellschaft, Dusseldorf, Fed. Rep. of Germany

[21] Appl. No.: 798,737

[22] Filed: May 19, 1977

[30] Foreign Application Priority Data

May 28, 1976 [DE] Fed. Rep. of Germany ..... 2623804

[51] Int. Cl.[2] ..... G06F 7/38; G06G 7/00; B65H 19/16

[52] U.S. Cl. ..... 235/92 CC; 235/92 FQ; 226/30; 226/111; 242/58.3

[58] Field of Search ..... 226/30, 31, 29, 40, 226/42, 28, 109, 111, 27; 235/92 CC, 92 FQ, 103, 103.5 R; 340/268, 681, 675, 676; 242/58.4, 58.3, 58.2, 58.1

[56] References Cited

U.S. PATENT DOCUMENTS

| | | | |
|---|---|---|---|
| 3,232,548 | 2/1966 | Bent et al. | 242/58.1 |
| 3,298,622 | 1/1967 | Raymond et al. | 242/58.1 |
| 3,768,904 | 10/1973 | Rodek | 226/29 X |
| 3,780,541 | 12/1973 | Haynes | 226/40 X |

*Primary Examiner*—Bruce H. Stoner, Jr.

*Attorney, Agent, or Firm*—Sprung, Felfe, Horn, Lynch & Kramer

[57] ABSTRACT

A synchronizing system for synchronizing the speeds of two webs of goods, wherein the first web runs at a constant speed and the second web has an adjustable running speed. First pulses are generated which have a frequency dependent upon the speed of the second web and a first counter is associated with the second web and is triggered by the first pulses. The first counter is also controlled to be started and stopped by at least one pair of timing marks which are running with the second web of goods. As a result of the frequency of the first pulses and the starting and stopping of the first counter, the first counter reaches a constant count upon stopping and each time the first counter is started for the next count this constant count is reached. Second pulses having a constant frequency associated with the speed of the first web are used to trigger a second counter which is started and stopped by the first counter when the constant count is reached. The count that is finally obtained in the second counter is indicative of the amount of over synchronization or under synchronization of the speed of the second web relative to the first web.

2 Claims, 2 Drawing Figures

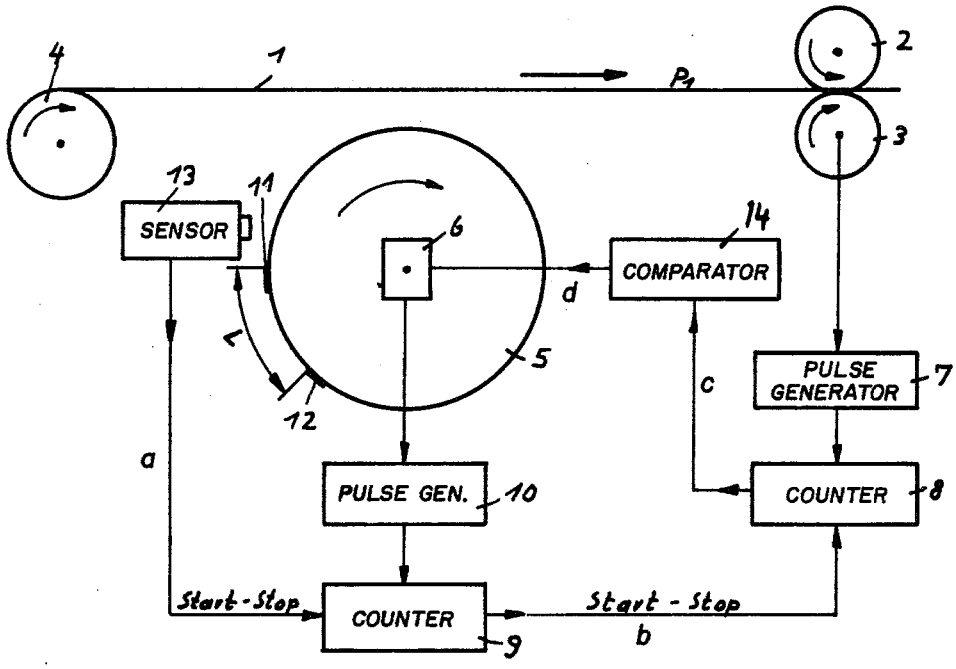
FIG. 1
FIG. 2a
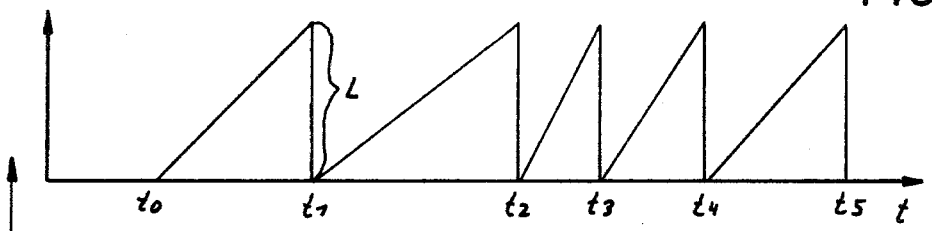
FIG. 2b
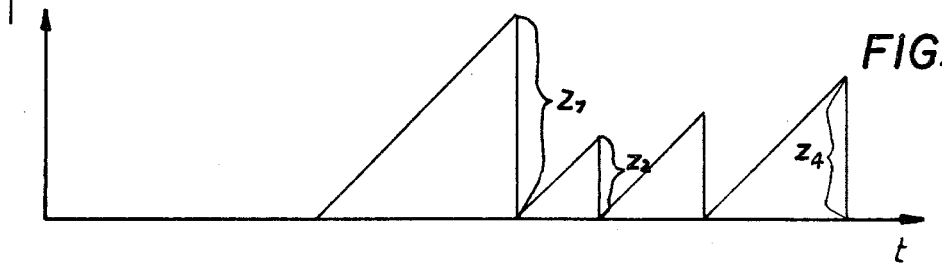

APPARATUS FOR SYNCHRONIZING THE SPEEDS OF TWO WEBS OF GOODS

BACKGROUND

The invention relates to a synchronizing system for synchronizing the speed of two webs of goods, one of which is running at constant speed and the other of which is adjustable in speed, the second web being associated with a counter triggered by its speed, which is started and stopped by at least one pair of marks running with this web.

In a known synchronizing system of this kind, the speed of the second web of goods wound on a roll is compared with the first web only once per revolution of the roll running at constant speed. The synchronization of the two web speeds can therefore take a long time and can be inaccurate. A rapid reaching of the synchronous speed when the roll of the web advancing at constant speed is dwindling is desirable so as to have enough reserve of web material for the adhering of the end of the one web to the start of the other web.

THE INVENTION

The invention is addressed to the problem of creating a synchronizing system of the above-described kind with which the synchronous rotatory speed can be reached in a minimum of time with the avoidance of errors.

This object is achieved in accordance with the invention by the fact that a counter is set for the count reached upon stopping and is started for the next count, and is restarted each time that the said count is reached, and that an additional counter triggered by the constant speed of the first web is provided, which is stopped and started each time by the first counter when the set count is reached, and whose count is a measure of the overspeed or underspeed of the second web of goods.

The invention sets out from the consideration that the distance between a pair of marks on the second web of goods will correspond to a certain number of pulses, the sequential rate of which will depend on the first web running at constant speed. Since the counter for these pulses delivered in constant succession is started and stopped in accordance with the speed of the second web of goods, a specific count will be reached in this counter only upon synchronization. By the triggering of the counter associated with second web of goods by the rotatory speed at the second roll of goods, and the starting and stopping by the marks disposed at a specific distance from one another, the speed at which the second web is running is represented by the count reached in the counter. If then the speed of the second web changes, the time in which the count is reached thus also changes. Therefore, a different counting time is given to the counter for the first web, so that its count also changes. Not until the change of the speed of the second web causes the counter associated with this web to emit a start-stop signal, upon which the counter associated with the first web reaches its preset count, is synchronization present.

BRIEF DESCRIPTION OF THE DRAWINGS

The invention will be further explained hereinbelow with the aid of a drawing representing an embodiment, in which FIG. 1 is a diagrammatic representation of the synchronization system, FIG. 2*a* is a pulse diagram representing the counting of pulses in one counter of the sychronization system, and FIG. 2*b* is a pulse diagram representing the counting of pulses in another counter of the synchronization system.

A web of goods 1 is drawn at constant speed in the direction of the arrow $P_1$ from a roll 4 by means of a pair of drive rolls 2–3. The supply of web material stored on the roll 4 dwindles and this is indicated by the small diameter of roll 4. A full roll 5 is disposed underneath the web 1. The end of web 1 is to be joined to the beginning of the new roll 5. To enable this to be accomplished while the web of goods is in movement, it is necessary to raise the circumferential speed of roll 5 to the linear speed of web 1. This is accomplished by means of a controllable drive 6.

A counter 8 is triggered with the constant speed of web 1 through a pulse generator 7. Another counter 9 is triggered by a pulse generator 10 with the rotatory speed of the new roll 5. On the circumference of the new roll 5 there are located, at a distance L between them, two pulse marks 11–12. Through a sensor 13, the pulse mark 11 starts the counter 9, while the pulse mark 12 stops counter 9.

The counter 9 is actuated to a count corresponding to the spacing L between the marks 11 and 12. By the stop signal, the counter 9 is stopped at this count and returned to zero to start again to count up to this number. This recount is repeated until the mark 11 through the sensor 13 again starts counter 9 and mark 12 again actuates counter 9 to the count corresponding to the length L.

The count into counter 9 in the time interval $t_O$ to $t_1$ is represented in FIG. 2(*a*). At $t_1$, the count corresponding to the value L is entered in the counter. The succeeding counting operations are performed always only up to the value L, as the diagram shows. How rapidly this value is reached depends on the rotatory speed of the roll 5. Although in the period from $t_O$ to $t_1$ the rotatory speed did not change, it increased in the period from $t_2$ to $t_3$. In the period from $t_3$ to $t_4$ it decreased slightly in comparison with the period from $t_2$ to $t_3$. In the time from $t_4$ to $t_5$ it decreased still further. The time intervals $t_1$ to $t_2$, $t_2$ to $t_3$, $t_3$ to $t_4$, and $t_4$ to $t_5$ are identical to the time intervals for each counting operation of the counter 8. FIG. 2(*b*) indicates how the counting actions take place and as shown the counter 8 is started, reset to zero and restarted. Since the pulse sequence of the pulse generator 7 is constant, the ascending flank is constant in each interval. Only the number of pulses counted changes. In the time interval $t_1$ to $t_2$ the count $Z_1$ is greater than the count corresponding to the value L. Consequently, the time interval for the counting action must be reduced by increasing the rotatory speed of roll 5. The next time interval $t_2$ to $t_3$ is shorter, but too short, for in this time interval the count $Z_2$ which has been reached is lower than the count corresponding to the value L. The time interval must thus be lengthened by decreasing the rotatory speed. In the interval $t_4$ to $t_5$, the count $Z_4$ has been reached, which corresponds to the count for L. Synchronization has thus been reached.

The count of counter 8 can be connected to a comparing instrument 14 in which the count corresponding to the value L is stored. This comparing instrument adjusts the drive 6 in accordance with the difference between the actual speed and the correct speed.

Although in the synchronizing system of the invention pulse marks are located on a relatively short, fixedly prescribed section of the circumference, the invention also permits a comparison in the rest of the circumference between the speed of roll 5 and the speed of the web 1, independently of the diameter of the roll 5.

In operation, the pulse generator 10 produces impulses in accordance with the rotation of the roll 5.

As soon as the timing mark 11 arrives at the sensor 13, a "start" signal is given by way of line a and the counter 9 commences counting. When the timing mark 12 arrives at the sensor, a "stop" signal passes over line a and the counter 9 stops counting and has a particular numerical value counted therein. Since the roll 5 is still rotating and the pulse generator 10 is still generating pulses triggered by this rotation, the counter 9 is restarted to 0 and immediately starts to count again, each time up to the particular numerical value which was set by use of the timing marks 11 and 12. Thus, counter 9 counts each time in order to reach the numerical value and is then restarted at 0 and immediately starts to count again to the known pulse. Then, when the mark 11 again appears at the sensor at some later time, the residual number which happens to be in the counter 9 is erased by the "start" signal and counter 9 again begins to count from 0 and an updated numerical value will be set in the counter when the timing mark 12 arrives.

This above-mentioned timing pattern is shown graphically in FIG. 2*a* wherein it is seen at $t_O$ that the mark 11 is at the sensor 13 and at $t_1$ the mark 12 is at sensor 13. In the interval between $t_O$ and $t_1$, the length L which is expressed in numbers of pulses was counted and at $t_1$ this number is set into the counter 9. In the interval between $t_1$ and $t_2$, counter 9 is restarted to count again starting with 0 up to the set number. As is evident from the timing chart shown, the roll 5 is now running somewhat more slowly than before, because the time $t_1$–$t_2$ is greater than $t_O$–$t_1$, which means that more time is used up until the number is reached in the counter 9. It is also clear that since less time is used between $t_2$ and $t_3$, this means that the roll 5 runs faster and this is shown by the fact that there is a shorter distance between $t_2$ and $t_3$ than $t_O$ and $t_1$. Finally, synchronism is achieved with the web of goods 1 between $t_4$ and $t_5$ since the time $t_4$–$t_5$ is equal to the time $t_O$–$t_1$. How this synchronism comes about, will be explained with reference to the second counter 8 and the comparator 14.

The web of goods 1 is drawn at a constant speed by the drive rollers 2 and 3 and the pulse generator 7 produces pulses in a constant sequence, based on the advance of the web 1. The pulses from pulse generator 7 are counted in counter 8. By means of the line b from the counter 9, a start and stop signal is applied to counter 8, starting at time $t_1$. When counter 8 receives the start signal, it counts its own pulses from pulse generator 7 until it is interrupted by a stop signal at $t_2$. At this moment, the counter 8 indicates a counted value $Z_1$, as shown in FIG. 2*b*, which is sent over line c into comparator 14. The stop signal for counter 8 is in reality a restart signal which effects counter 8 to start counting again from 0, the pulses coming from pulse generator 7 until it is stopped at $t_3$ by another "restart" signal. At $t_3$, the numerical value $Z_2$ is sent to the comparator and the counter 8 is restarted again to generate counts at $t_4$ and then at $t_5$, etc.

The comparator compares the value sent over line c to a fixed value which corresponds to the length L.

As the automatic control system of the invention begins to function, the comparator 14 indicates at $t_2$ that the numerical value $Z_1$ amounts to more than the standard value L. This means that the roll 5 rotated too slowly in the interval from $t_1$ to $t_2$, since more than the desired number of pulses reached the comparator 14 from the counter 8. Therefore, the comparator, over line d, effects control of the drive 6 of the roll 5 in order to go faster or increase the number of revolutions per second. After this is done, a new stop signal comes over line b at $t_3$, stopping counter 8, whereupon the counted value $Z_2$ is sent to the comparator 14 and the counter 8 is restarted. The comparator 14 now indicates that $Z_2$ is smaller than the standard value L and thus the roll 5 moved too fast in the interval from $t_2$ to $t_3$ compared with the speed of the web. Therefore, the drive 6 is ordered to go slower until, as shown in time interval $t_4$–$t_5$, the numerical value $Z_4$ is equal to the numerical value of the length L.

Thus, at time $t_5$, there is synchronism between the circumference of the roll 5 and the web 1 which is advanced at constant speed.

It will be appreciated that the instant specification and examples are set forth by way of illustration and not limitation, and that various modifications and changes may be made without departing from the spirit and scope of the present invention.

What is claimed is:

1. In a synchronizing system for synchronizing the speeds of two webs of goods, wherein the speed of the first web is adjustable and the speed of the second web is constant and including first means for generating first pulses dependent upon the speed of the first web and a first counter associated with the first web and triggered by the first pulses, the improvement which comprises means for controlling the first counter to continuously count to a desired numerical value comprising at least one pair of timing marks running with the first web and means for detecting the timing marks to start the first counter at the first mark and stop and reset same at the second mark to set same to the counted number defining the desired numerical value, wherein the first pulse generating means effects the first counter to thereafter continuously restart and count to the desired numerical value and restart again; second pulse generating means for generating constant frequency second pulses associated with the constant speed of the second web, a second counter triggered by the second pulses and which is started, reset and restarted by the first counter when the desired numerical value is reached in the first counter to obtain a count in the second counter and means comparing the count in the second counter to a constant value representative of the constant speed of the second web to indicate whether the speed of the first web is greater or lesser than the constant speed of the second web.

2. The synchronizing system according to claim 1, wherein the comparing means effects control of the speed of the first web to synchronize the speed of same to the second web.

* * * * *